US008640264B2

(12) United States Patent
Ramer

(10) Patent No.: US 8,640,264 B2
(45) Date of Patent: Feb. 4, 2014

(54) CAP WHICH UTILIZES AN AIRFOIL EFFECT FOR INDUCING COOLING

(75) Inventor: Jon Vincent Ramer, San Pedro, CA (US)

(73) Assignee: Jon Ramer, Las Vegas, NV (US)

( * ) Notice: Subject to any disclaimer, the term of this patent is extended or adjusted under 35 U.S.C. 154(b) by 0 days.

(21) Appl. No.: 12/803,586

(22) Filed: Jul. 1, 2010

(65) Prior Publication Data

US 2012/0000006 A1 Jan. 5, 2012

(51) Int. Cl.
*A42B 1/06* (2006.01)
*A42C 5/04* (2006.01)

(52) U.S. Cl.
USPC ..... 2/195.1; 2/171.3

(58) Field of Classification Search
USPC ..... 2/195.1, 195.5, 171.3, 181, 195.6, 2/195.7, 171, 171.4–171.6, 172, 181.2, 2/181.6, 182.1, 182.7, 184.5, 175.1, 2/209.7, 182.3, 7, 10, DIG. 1, 209.3; D2/893
See application file for complete search history.

(56) References Cited

U.S. PATENT DOCUMENTS 630,707 A * 8/1899 Jacobson ..... 2/10
911,432 A * 2/1909 Pachner ..... 2/209.12
1,677,187 A * 7/1928 Leibson ..... 2/10
1,716,719 A * 6/1929 Christopher ..... 2/10
1,748,375 A * 2/1930 Wittcoff ..... 2/182.1
2,462,258 A * 2/1949 Dannenberg ..... 2/195.5
2,735,109 A * 2/1956 Feldman ..... 2/172
2,874,387 A * 2/1959 Bannister et al. ..... 2/195.1
3,925,821 A * 12/1975 Lewicki ..... 2/425
3,927,421 A * 12/1975 Simon ..... 2/12
4,114,201 A * 9/1978 Garrison ..... 2/209.7
4,519,099 A * 5/1985 Kamiya et al. ..... 2/424
4,550,445 A * 11/1985 Fender ..... 2/181.6
5,553,325 A * 9/1996 Gutierrez ..... 2/171
5,778,454 A * 7/1998 Oxman ..... 2/195.1
5,781,933 A * 7/1998 De Giacomi ..... 2/195.1
5,855,023 A * 1/1999 Clingenpeel et al. ..... 2/7
6,367,084 B1 * 4/2002 Keast ..... 2/182.7
7,185,371 B2 * 3/2007 Koo ..... 2/209.13
D612,134 S * 3/2010 Hoffman ..... D2/872
D637,797 S * 5/2011 Kim ..... D2/893
D658,854 S * 5/2012 Cobb ..... D2/882
2007/0061937 A1 * 3/2007 Curle ..... 2/12
2009/0288238 A1 * 11/2009 Greene, Jr. ..... 2/171.3

FOREIGN PATENT DOCUMENTS

WO WO 00/69296 * 11/2000

* cited by examiner

*Primary Examiner* — Amy Vanatta

(57) ABSTRACT

By adding a second smaller bill under the main bill of a cap and creating a gap from the front to the back between the two bills, the two bills create a curved shape that acts like an airfoil and allows the free flow of air over a wearer's forehead, inducing a cooling effect. Besides the benefit of a cooling effect, the appearance of the hat is such that an observer looking at someone wearing it would not be able to tell there was anything overtly different about the design.

1 Claim, 3 Drawing Sheets

Front Oblique View

Figure 1, Front Oblique View
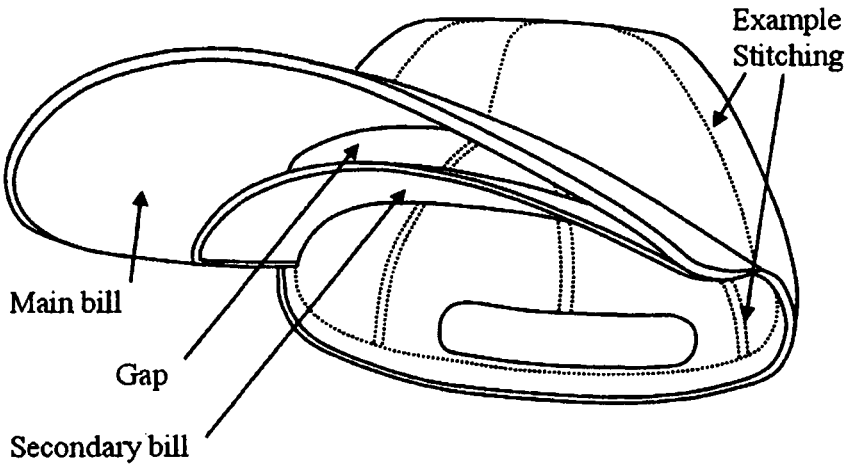
Figure 2, Placement View
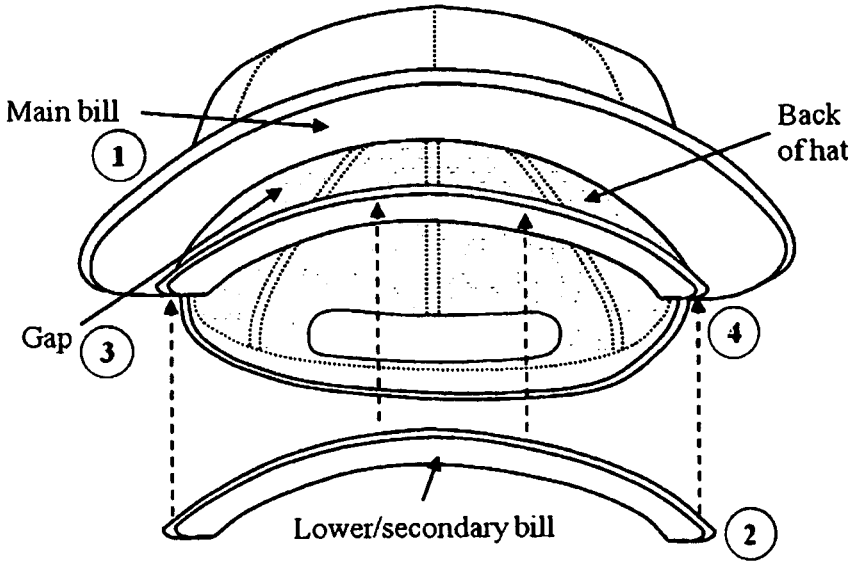

Figure 3, Bottom Oblique View
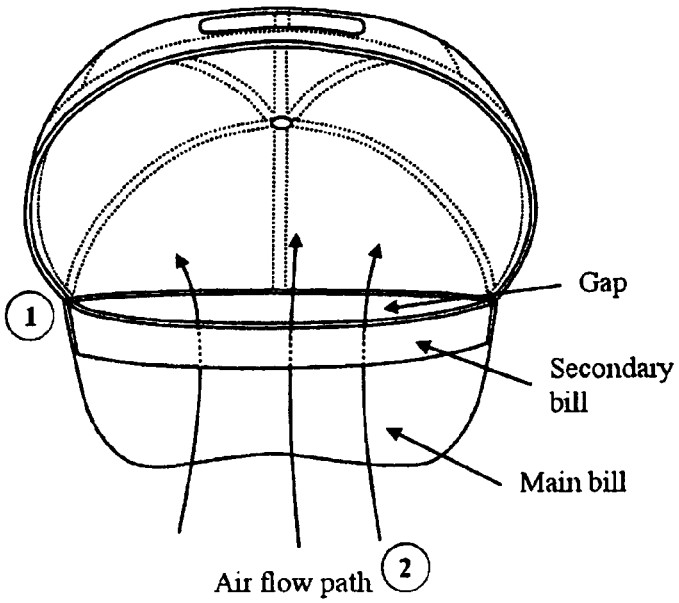
Figure 4, Cutaway Side View
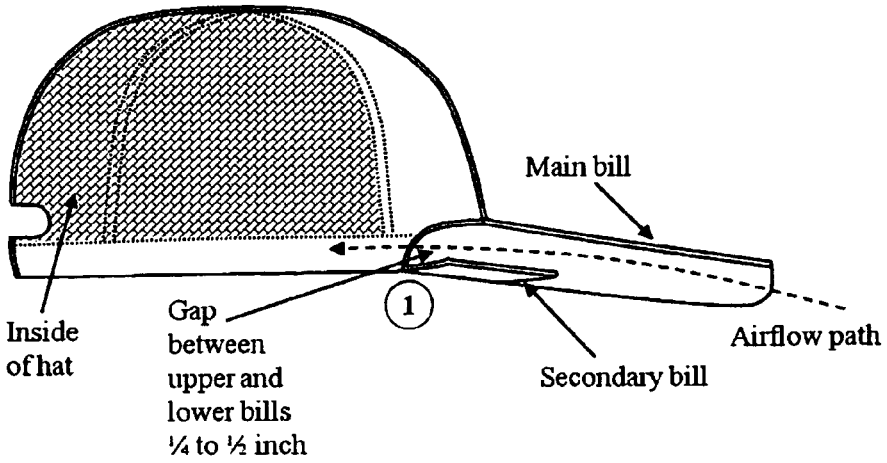

Figure 5, Side View
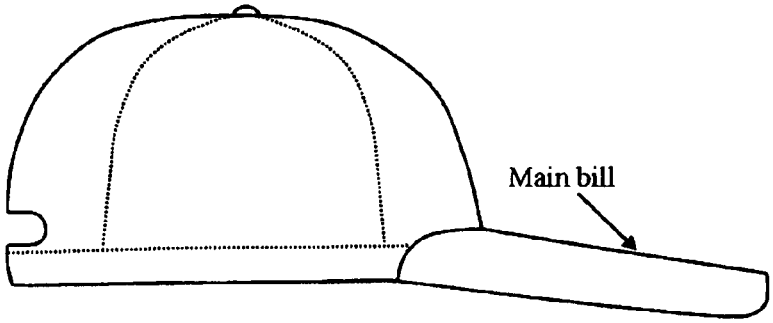
Figure 6, Bottom View
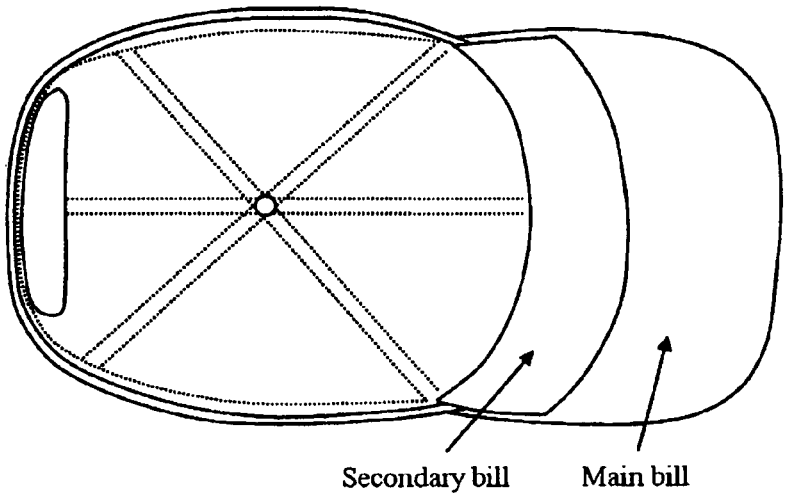

CAP WHICH UTILIZES AN AIRFOIL EFFECT FOR INDUCING COOLING

FIELD OF THE INVENTION

This invention relates to apparel, specifically, the invention concerns headwear, such as a "baseball" cap or hat designed to keep sunlight, rain, and possibly perspiration out of a wearer's eyes. A standard cap design includes a visor over the eyes and a crown over the head. There are many variations of this arrangement utilizing many different materials with "fitted" and "adjustable" designs. In particular, this invention relates to a design, herein called an "AirCap," that creates a cooling flow of air over a wearer's head. All other patent design variations will work with the AirCap design addition.

BACKGROUND OF THE INVENTION

Baseball caps were originally invented as athletic equipment for baseball players to keep sunlight, rain, and perspiration out of their eyes. Since then caps of similar design and function have achieved a large popularity in other sports and the general population. There are many designs and variations to allow adjusting the size, moving the visor, decorating the front of the cap, cut-out sections for hair and airflow, insertion of spacers or bands for absorption of perspiration, imbedded lights and varying shape designs. There are also designs for creating a cap that cools a wearer involving electric fans in the bill, detachable cold packs, circulating water tubes, and more. There are no designs however, that enhance the natural cooling of air flow.

SUMMARY OF THE INVENTION

This invention features a smaller secondary bill underneath the main visor of a cap and a gap between the two bills from front to back. The upper bill is slightly curved upwards. This creates an airfoil shape and draws air into the gap, thereby creating a flow of air over the wearer's head and inducing a cooling effect while not affecting any other functionality or the general appearance of the hat. The airfoil design even creates a flow of air over the head in the slightest cross breeze or at walking pace, making it very effective for increasing the comfort of spectators, golf players, joggers, softball and baseball players, or any other athletic activity where a hat or cap is worn.

BRIEF DESCRIPTION OF THE DRAWINGS

In the drawings:

FIG. 1. Front oblique view of AirCap.

FIG. 2. Placement view of bills on AirCap.

FIG. 3. Oblique view from underneath AirCap looking forward.

FIG. 4. Cross section side view of AirCap design.

FIG. 5. Full side view of AirCap design.

FIG. 6. Bottom view of AirCap design.

DETAILED DESCRIPTION OF THE INVENTION

The attached drawings are to demonstrate the principles of the airfoil cooling design of the AirCap. The design of the rest of the cap may vary depending upon user desire.

The AirCap is constructed to create an airfoil shape out of the two visors (FIG. 1). According to aerodynamic principles, air flowing over the top curve of an airfoil has a longer distance to travel and therefore must move faster than the air travelling under the airfoil. This principle is what creates lift in a wing. A curved bill also funnels air up the curve.

By constructing an AirCap with a main visor or bill 1 in the front with the main bill 1 deliberately curved upwards where it is attached to the cap, the main bill 1 becomes the top of curve of an airfoil shape (FIG. 2). Placing a short, flat or lesser curved second visor 2 underneath the main bill (FIG. 2) where the bill meets a wearer's head will create the bottom of an airfoil shape 3 (FIG. 2). The main bill 1 is attached to the cap, the secondary bill 2 is attached to the main bill on the sides 4 (FIG. 2). This creates an open gap between the two bills from front to back, as seen in the cross section drawing (FIG. 4).

The main bill is curved and measures wider than the secondary bill, permanently attaching them at the sides will maintain the curvature of the main bill 1 (FIG. 3). The size for the gap between the bills at the highest point is approximately one half inch (FIG. 4). The second bill is approximately one and a half inches long. The airfoil shape of the visor assembly creates a minor pressure difference under the main bill which funnels air into the gap and over a wearer's head (FIG. 3).

A slight cross-breeze or front breeze, or even air motion caused by a walking pace will induce a noticeable flow of air over a wearer's forehead and create a cooling effect. From the side (FIG. 5) the exterior design of the AirCap is not noticeably different than any other baseball-type cap. Making the second bill the same color as the underside of the main bill will camouflage the design even more (FIG. 6). Note that there is still plenty of room on the front of an AirCap to place team or corporate logos.

It is understood that the invention is not confined to the particular embodiments set forth herein as illustrative, but embraces all such modifications thereof as come within the scope of the design claims.

What is claimed is:

1. A cap consisting of:

a main upper bill in the front of the cap, attached to a crown of the cap which extends over the head;

the main bill is curved upwards where it is attached to the crown;

a second lower bill placed underneath the main bill, the second bill being shorter than the main bill and flat or lesser curved than the main bill;

the second bill being permanently attached to the main bill at each side and being unattached to the main bill between the sides so as to form an open gap between the bills;

the main bill and second bill together forming an airfoil shape when viewed from the front;

the open gap extending between the two bills from front to back, with no obstructions;

wherein the gap between the bills funnels a free flow of air from outside the cap to inside the crown.

* * * * *